US008907992B2

(12) United States Patent
Yang et al.

(10) Patent No.: US 8,907,992 B2
(45) Date of Patent: Dec. 9, 2014

(54) OVERDRIVING VALUE GENERATING METHOD

(75) Inventors: Fu-Chi Yang, Miao-Li County (TW); Guo-Wei Peng, Miao-Li County (TW); Ching-Hung Liu, Miao-Li County (TW); Shih-Hsiang Ting, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 579 days.

(21) Appl. No.: 13/210,314

(22) Filed: Aug. 15, 2011

(65) Prior Publication Data

US 2012/0056908 A1 Mar. 8, 2012

(30) Foreign Application Priority Data

Sep. 7, 2010 (TW) ..... 99130237 A

(51) Int. Cl.
*G09G 5/10* (2006.01)
*G09G 3/36* (2006.01)

(52) U.S. Cl.
CPC ..... *G09G 3/3611* (2013.01); *G09G 2320/0252* (2013.01); *G09G 2340/16* (2013.01)
USPC ..... 345/690; 345/89

(58) Field of Classification Search
USPC ..... 345/690
See application file for complete search history.

(56) References Cited

U.S. PATENT DOCUMENTS

| | | | | |
|---|---|---|---|---|
| 6,304,254 | B1 * | 10/2001 | Johnson et al. | 345/204 |
| 7,015,930 | B2 * | 3/2006 | Gruber | 345/606 |
| 7,382,349 | B1 * | 6/2008 | Kuhns | 345/102 |
| 2005/0146495 | A1 * | 7/2005 | MacKinnon et al. | 345/98 |
| 2012/0230608 | A1 * | 9/2012 | Pan | 382/300 |

FOREIGN PATENT DOCUMENTS

| | | |
|---|---|---|
| CN | 101393729 | 3/2009 |
| CN | 101656054 | 2/2010 |
| TW | 200802248 | 1/2008 |

OTHER PUBLICATIONS

Electronics for Fun: image zooming with MATLAB sample codes; Published Monday, Jul. 15, 2013: http://supuntharanga.blogspot.com/2013/07/image-zooming-with-matlab-sample-codes.html.*
Chinese language office action dated Mar. 4, 2013
English language translation of abstract of CN 101393729 (published Mar. 25, 2009).
English language translation of abstract of CN 101656054 (published Feb. 24, 2010).
Taiwanese language office action dated Jul. 29, 2013.
English language translation of abstract of TW 200802248 (published Jan. 1, 2008).

* cited by examiner

*Primary Examiner* — Alexander S Beck
*Assistant Examiner* — Mihir Rayan
(74) *Attorney, Agent, or Firm* — McClure, Qualey & Rodack, LLP

(57) ABSTRACT

An overdriving value generating method adapted to a liquid crystal display (LCD) is provided. The overdriving value generating method includes the following steps. A current gray value and a previous gray value are received. A first gray reference value and a second gray reference value closed to the current gray value, and a first previous gray reference value and a second previous gray reference value closed to the previous gray value, and four first overdriving values are obtained according a look-up table (LUT). A target overdriving value corresponding to the current gray value and the previous gray value is obtained through a four dots interpolation operation or a parallelogram interpolation operation according to the current gray value, the previous gray value, the first gray reference value, the second gray reference value, the first previous gray reference value, the second previous gray reference value, and the first overdriving values.

16 Claims, 5 Drawing Sheets

OVERDRIVING VALUE GENERATING METHOD

CROSS-REFERENCE TO RELATED APPLICATION

This application claims the priority benefit of Taiwan application serial no. 99130237, filed Sep. 7, 2010. The entirety of the above-mentioned patent application is hereby incorporated by reference herein and made a part of this specification.

BACKGROUND

1. Field of the Invention

The invention relates to an overdriving technique. Particularly, the invention relates to an overdriving value generating method.

2. Description of Related Art

Along with development of modern video technology, liquid crystal displays (LCDs) have been widely used as displays of consumer electronic products. However, since a LCD panel of the LCD does not emit light itself, a backlight module is disposed under the LCD panel to provide a light source required by the LCD panel, so as to achieve a display effect. Most of the current LCDs apply a hold type backlight module to provide the required light source with a fixed light amplitude. Therefore, when the LCD displays a static image, an image flickering problem is not occurred, and the user' eye may have a comfortable feeling when watching the static image.

However, when the LCD displays dynamic images, since the human eye operates in an integrating mode, the hold type backlight may cause obscure of the image outline or image sticking and ghost image phenomenon when the dynamic image is displayed, which is the so-called motion blur. In order to resolve the above problem, the conventional technique applies an overdriving (OD) technique to shorten a pixel response time.

Presently, when the overdriving technique is used, a look-up table is required to be established to record overdriving values corresponding to different gray values, and a signal of the gray value to be output is modified according to the look-up table, so as to shorten the response time of the liquid crystal. Moreover, the size of the look-up table is the square of the resolution of the gray value signal, namely, the look-up table establishes the overdriving value corresponding to each gray value with reference of a previous gray value and a current gray value. In this way, the overdriving values can correctly correspond to the gray levels. However, considering hardware cost, the size of the look-up table is reduced, so that the number of the recorded previous gray values and the gray values are reduced. Moreover, the previous gray values and the gray values that are not recorded on the look-up table can only be obtained by referring to the closed previous gray values and the closed gray values, which makes the output overdriving values are not accurate.

SUMMARY OF THE INVENTION

The invention is directed to an overdriving value generating method, by which accuracy of an overdriving value is improved while a size of a look-up table is reduced.

The invention provides an overdriving value generating method adapted to a liquid crystal display (LCD). The overdriving value generating method includes the following steps. A current gray value and a previous gray value are received, where the current gray value and the previous gray value commonly correspond to a pixel of the LCD. A first gray reference value and a second gray reference value closed to the current gray value, and a first previous gray reference value and a second previous gray reference value closed to the previous gray value are obtained according to a look-up table. Moreover, four first overdriving values are obtained according the first gray reference value, the second gray reference value, the first previous gray reference value and the second previous gray reference value. A target overdriving value corresponding to the current gray value and the previous gray value is obtained through a four dots interpolation operation according to the current gray value, the previous gray value, the first gray reference value, the second gray reference value, the first previous gray reference value, the second previous gray reference value and the first overdriving values.

The invention provides an overdriving value generating method adapted to a liquid crystal display (LCD). The overdriving value generating method includes the following steps. A current gray value and a previous gray value are received, where the current gray value and the previous gray value commonly correspond to a pixel of the LCD. A first gray reference value and a second gray reference value closed to the current gray value, and a first previous gray reference value and a second previous gray reference value closed to the previous gray value are obtained according to a look-up table. Moreover, four first overdriving values are obtained according the first gray reference value, the second gray reference value, the first previous gray reference value and the second previous gray reference value. The first gray reference value is the same to the first previous gray reference value, and the second gray reference value is the same to the second previous gray reference value. A target overdriving value corresponding to the current gray value and the previous gray value is obtained through a parallelogram interpolation operation according to the current gray value, the previous gray value, the first gray reference value, the second gray reference value, the first previous gray reference value, the second previous gray reference value and the first overdriving values.

The invention provides an overdriving value generating method adapted to a liquid crystal display (LCD). The overdriving value generating method includes the following steps. A current gray value and a previous gray value are received, where the current gray value and the previous gray value commonly correspond to a pixel of the LCD. A first gray reference value and a second gray reference value closed to the current gray value, and a first previous gray reference value and a second previous gray reference value closed to the previous gray value are obtained according to a look-up table. Moreover, four first overdriving values are obtained according the first gray reference value, the second gray reference value, the first previous gray reference value and the second previous gray reference value. When the first gray reference value is different to the first previous gray reference value, or the second gray reference value is different to the second previous gray reference value, a target overdriving value corresponding to the current gray value and the previous gray value is obtained through a four dots interpolation operation according to the current gray value, the previous gray value, the first gray reference value, the second gray reference value, the first previous gray reference value, the second previous gray reference value and the first overdriving values. When the first gray reference value is the same to the first previous gray reference value, and the second gray reference value is the same to the second previous gray reference value, the target overdriving value is obtained through a parallelogram interpolation operation according to the current gray value, the previous gray value, the first gray reference value, the second gray reference value, the first previous gray reference value, the second previous gray reference value and the first overdriving values.

In an embodiment of the invention, the four dots interpolation operation includes following steps. An interpolation operation is performed according to the current gray value, the first gray reference value, the second gray reference value, and two first overdriving values corresponding to the first previous gray reference value to obtain a second overdriving value. An interpolation operation is performed according to the current gray value, the first gray reference value, the second gray reference value, and two first overdriving values corresponding to the second previous gray reference value to obtain a third overdriving value. Then, an interpolation operation is performed according to the previous gray value, the first previous gray reference value, the second previous gray reference value, the second overdriving value and the third overdriving value to obtain the target overdriving value.

In an embodiment of the invention, the four dots interpolation operation includes following steps. An interpolation operation is performed according to the previous gray value, the first previous gray reference value, the second previous gray reference value, and two first overdriving values corresponding to the first gray reference value to obtain a second overdriving value. An interpolation operation is performed according to the previous gray value, the first previous gray reference value, the second previous gray reference value, and two first overdriving values corresponding to the second gray reference value to obtain a third overdriving value. Then, an interpolation operation is performed according to the current gray value, the first gray reference value, the second gray reference value, the second overdriving value and the third overdriving value to obtain the target overdriving value.

In an embodiment of the invention, when a difference between the current gray value and the first gray reference value is greater than a difference between the previous gray value and the first previous gray reference value, the parallelogram interpolation operation includes following steps. An operation is performed according to two first overdriving values corresponding to the second gray reference value to obtain an average overdriving value. An operation is performed according to the average overdriving value and the first overdriving value corresponding to the first gray reference value and the first previous gray reference value to obtain an extending overdriving value, where the extending overdriving value is twice of the average overdriving value minus the first overdriving value corresponding to the first gray reference value and the first previous gray reference value. An interpolation operation is performed according to the previous gray value, the first previous gray reference value, the second previous gray reference value, the extending overdriving value, and the first overdriving value corresponding to the second gray reference value and the first previous gray reference value to obtain a second overdriving value. An interpolation operation is performed according to the previous gray value, the first previous gray reference value, the second previous gray reference value, the extending overdriving value, the first overdriving value corresponding to the first gray reference value and the first previous gray reference value, and the first overdriving value corresponding to the second gray reference value and the second previous gray reference value to obtain a third overdriving value. An interpolation operation is performed according to the current gray value, the first gray reference value, the second gray reference value, the second overdriving value and the third overdriving value to obtain the target overdriving value.

In an embodiment of the invention, when a difference between the current gray value and the first gray reference value is greater than a difference between the previous gray value and the first previous gray reference value, the parallelogram interpolation operation includes following steps. An operation is performed according to two first overdriving values corresponding to the first previous gray reference value to obtain an average overdriving value. An operation is performed according to the average overdriving value and the first overdriving value corresponding to the second gray reference value and the second previous gray reference value to obtain an extending overdriving value, where the extending overdriving value is twice of the average overdriving value minus the first overdriving value corresponding to the second gray reference value and the second previous gray reference value. An interpolation operation is performed according to the current gray value, the first gray reference value, the second gray reference value, the extending overdriving value, and the first overdriving value corresponding to the second gray reference value and the first previous gray reference value to obtain a second overdriving value. An interpolation operation is performed according to the current gray value, the first gray reference value, the second gray reference value, the first overdriving value corresponding to the first gray reference value and the first previous gray reference value, and the first overdriving value corresponding to the second gray reference value and the second previous gray reference value to obtain a third overdriving value. An interpolation operation is performed according to the previous gray value, the first previous gray reference value, the second previous gray reference value, the second overdriving value and the third overdriving value to obtain the target overdriving value.

In an embodiment of the invention, when a difference between the current gray value and the first gray reference value is smaller than a difference between the previous gray value and the first previous gray reference value, the parallelogram interpolation operation includes following steps. An operation is performed according to two first overdriving values corresponding to the first gray reference value to obtain an average overdriving value. An operation is performed according to the average overdriving value and the first overdriving value corresponding to the second gray reference value and the second previous gray reference value to obtain an extending overdriving value, where the extending overdriving value is twice of the average overdriving value minus the first overdriving value corresponding to the second gray reference value and the second previous gray reference value. An interpolation operation is performed according to the previous gray value, the first previous gray reference value, the second previous gray reference value, the extending overdriving value, and the first overdriving value corresponding to the first gray reference value and the second previous gray reference value to obtain a second overdriving value. An interpolation operation is performed according to the previous gray value, the first previous gray reference value, the second previous gray reference value, the first overdriving value corresponding to the first gray reference value and the first previous gray reference value, and the first overdriving value corresponding to the second gray reference value and the second previous gray reference value to obtain a third overdriving value. An interpolation operation is performed according to the current gray value, the first gray reference value, the second gray reference value, the second overdriving value and the third overdriving value to obtain the target overdriving value.

In an embodiment of the invention, when a difference between the current gray value and the first gray reference value is smaller than a difference between the previous gray value and the first previous gray reference value, the parallelogram interpolation operation includes following steps. An operation is performed according to two first overdriving values corresponding to the second previous gray reference value to obtain an average overdriving value. An operation is performed according to the average overdriving value and the first overdriving value corresponding to the first gray reference value and the first previous gray reference value to obtain an extending overdriving value, where the extending overdriving value is twice of the average overdriving value minus the first overdriving value corresponding to the first gray reference value and the first previous gray reference value. An interpolation operation is performed according to the current gray value, the first gray reference value, the second gray reference value, the extending overdriving value, and the first overdriving value corresponding to the first gray reference value and the second previous gray reference value to obtain a second overdriving value. An interpolation operation is performed according to the current gray value, the first gray reference value, the second gray reference value, the first overdriving value corresponding to the first gray reference value and the first previous gray reference value, and the first overdriving value corresponding to the second gray reference value and the second previous gray reference value to obtain a third overdriving value. An interpolation operation is performed according to the previous gray value, the first previous gray reference value, the second previous gray reference value, the second overdriving value and the third overdriving value to obtain the target overdriving value.

In an embodiment of the invention, the current gray value is not equal to the first gray reference value and the second gray reference value.

In an embodiment of the invention, the previous gray value is not equal to the first previous gray reference value and the second previous gray reference value.

According to the above descriptions, in the overdriving value generating method, the first gray reference value, the second gray reference value, the first previous gray reference value, the second previous gray reference value and the four first overdriving values are obtained according to the current gray value and the previous gray value. Moreover, it is determined to perform the four dots interpolation operation or the parallelogram interpolation operation to obtain the target overdriving value corresponding to the current gray value and the previous gray value according to whether the first gray reference value is equal to the first previous gray reference value and whether the second gray reference value is equal to the second previous gray reference value. In this way, accuracy of the overdriving value is improved while the size of the look-up table is reduced.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
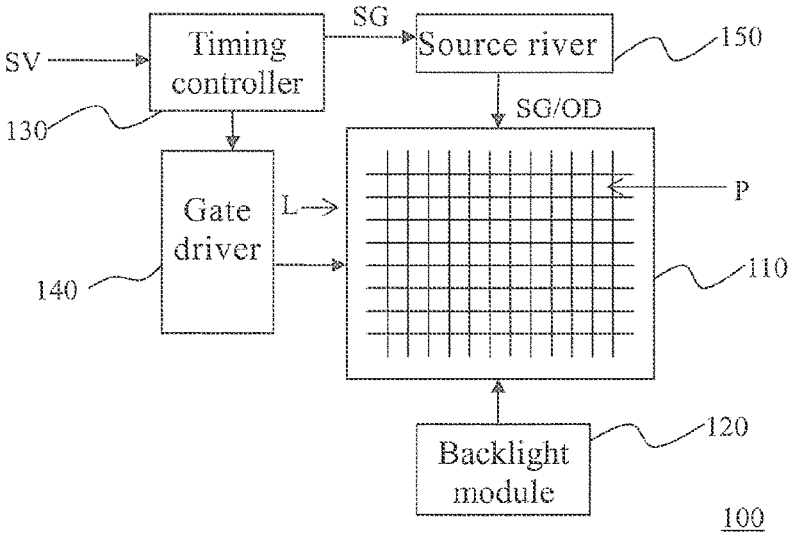
FIG. 1 is a system block diagram illustrating a liquid crystal display (LCD) according to an embodiment of the invention.

FIG. 1 is a system block diagram illustrating a liquid crystal display (LCD) according to an embodiment of the invention. Referring to FIG. 1, the LCD 100 includes a LCD panel 110, a light emitting diode (LED) backlight module 120, a timing controller (T-con) 130, a gate driver 140 and a source driver 150. The timing controller 130 receives a video signal SV, and outputs a current gray value SG to the source driver 150. The gate driver 140 is controlled by the timing controller 130 and sequentially turns on each pixel row (for example, a pixel row L) of the LCD panel 110.

The source driver 150 is also controlled by the timing controller 130, and provides a corresponding target overdriving value OD or the current gray value SG to the pixel row in the LCD panel 110 that is turned on by the gate driver 130. The target overdriving value OD is used to accelerate rotation of the liquid crystal of the LCD panel 110. The LED backlight module 120 provides a planar light source required by the LCD panel 110, and after the source driver 150 provides the corresponding gray value SG to from the first pixel row to the last pixel row of the LCD panel 110, the LCD panel 110 displays a complete frame.

Figure 2:
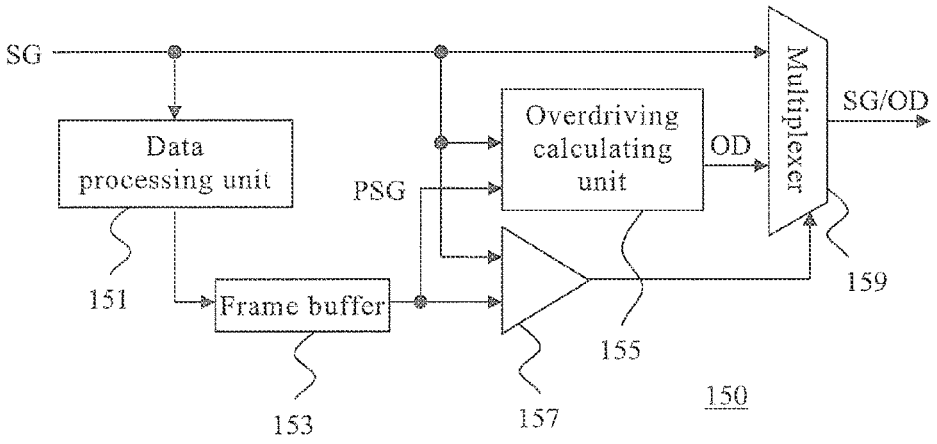
FIG. 2 is a system block diagram of a source driver of FIG. 1.

FIG. 2 is a system block diagram of a source driver of FIG. 1. Referring to FIG. 2, the source driver 150 includes a data processing unit 151, a frame buffer 153, an overdriving calculating unit 155, a comparator 157 and a multiplexer 159. The data processing unit 151 is used to convert the current gray value SG into a data format compatible to that of the frame buffer 153, and stores the converted current gray value SG in the frame buffer 153. The data processing unit 151 can convert the data format of the current gray value SG through a table look up method, or convert the data format of the current gray value SG through a mathematic operation. Moreover, if the data format of the frame buffer 153 is the same to that of the current gray value SG, the data processing unit 151 can be omitted.

The frame buffer 153 is used to store the current gray value SG, and outputs the current gray value SG during a next output period of a same pixel to serve as a previous gray value PSG. The overdriving calculating unit 155 performs an overdriving operation according to the current gray value SG and the previous gray value PSG to output a target overdriving value OD corresponding to the current gray value SG and the previous gray value PSG. The comparator 157 compares the current gray value SG and the previous gray value PSG, and controls the multiplexer 159 to output the target overdriving current OD when the current gray value SG and the previous gray value PSG are different, and controls the multiplexer 159 to output the current gray value SG when the current gray value SG and the previous gray value PSG are the same.

When the overdriving calculating unit 155 performs the overdriving operation, the overdriving calculating unit 155 first obtains a first gray reference value and a second gray reference value closed to the current gray value SG and a first previous gray reference value and a second previous gray reference value closed to the previous gray value PSG according to a look-up table. Moreover, the overdriving calculating unit 155 obtains four first overdriving values according the first gray reference value, the second gray reference value, the first previous gray reference value and the second previous gray reference value. Then, the overdriving calculating unit 155 performs a four dots interpolation operation or a parallelogram interpolation operation according to the current gray value SG, the previous gray value PSG, the first gray reference value, the second gray reference value, the first previous gray reference value, the second previous gray reference value and the first overdriving values, so as to obtain the target overdriving value OD corresponding to the current gray value SG and the previous gray value PSG.

The gray reference values and the previous gray reference values are gray values and previous gray values recorded in the look-up table, and the current gray value SG and the previous gray value PSG used in the operation commonly correspond to a same pixel (for example, a pixel P) of the LCD panel 110. Moreover, the overdriving calculating unit 155 determines to perform the four dots interpolation operation or the parallelogram interpolation operation according to whether two first overdriving values are located on a diagonal of the look-up table, or determines to perform the four dots interpolation operation or the parallelogram interpolation operation according to whether the first gray reference value is the same to the first previous gray reference value and whether the second gray reference value is the same to the second previous gray reference value.

It should be noticed that a size of the look-up table can be 9×9, 17×17 or 33×33. Taking the 9×9 look-up table as an example, a space between each two gray reference values or each two previous gray reference values is 32 (i.e. 256/(9−1)). Taking the 17×17 look-up table as an example, a space between each two gray reference values or each two previous gray reference values is 16 (i.e. 256/(17-1)). Taking the 33×33 look-up table as an example, a space between each two gray reference values or between each two previous gray reference values is 8 (i.e. 256/(33-1)). It should be noticed that the gray reference values and the previous gray reference values of the following embodiments are only used for descriptions, which are not limited to the specification of the look-up table.

Figure 3:
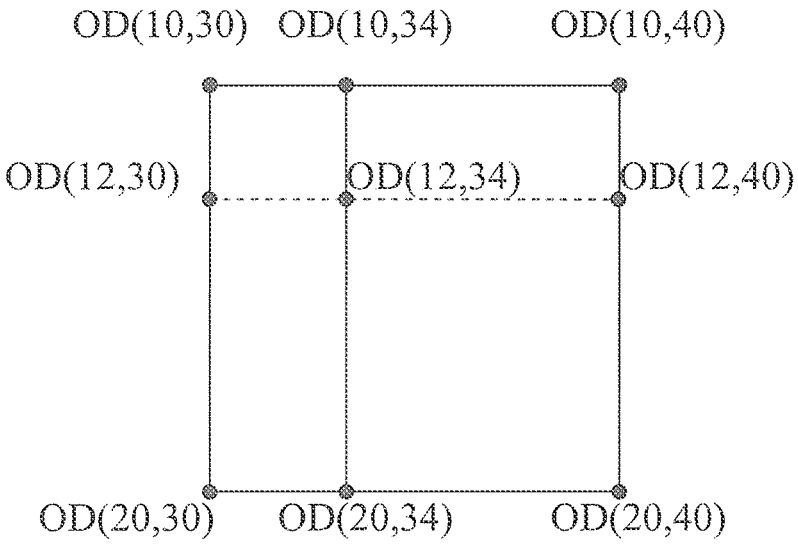
FIG. 3 is an operation schematic diagram of a four dots interpolation method according to an embodiment of the invention.

FIG. 3 is an operation schematic diagram of a four dots interpolation method according to an embodiment of the invention. Referring to FIG. 3, in the present embodiment, OD(10,30) represents an overdriving value corresponding to a gray value (or a gray reference value) of 30 and a previous gray value (or a previous gray reference value) of 10, OD(20, 40) represents an overdriving value corresponding to a gray value of 40 and a previous gray value of 20, and the others are deduced by analogy. Assumed that the current gray value SG received by the overdriving calculating unit 155 is 34, the previous gray value PSG is 12, and then, according to the look-up table, the first gray reference value is 30, the second gray reference value is 40, the first previous gray reference value is 10, and the second previous gray reference value is 20, the first overdriving values OD(10,30), OD(10,40), OD(20,30) and OD(20,40) are assumed to be 40, 50, 35 and 45 respectively.

In the four dots interpolation operation, a second overdriving value OD(10,34) is obtained according to the first overdriving values OD(10,30) and OD(10,40) corresponding to the first previous gray reference value (10) and the current gray value SG(34), the first gray reference value (30) and the second gray reference value (40). Moreover, a third overdriving value OD(20,34) is obtained according to the first overdriving values OD(20,30) and OD(20, 40) corresponding to the second previous gray reference value (20) and the current gray value SG(34), the first gray reference value (30) and the second gray reference value (40). Finally, an interpolation operation is performed according to the previous gray value PSG(12), the first previous gray reference value (10), the second previous gray reference value (20), the second overdriving value OD(10,34) and the third overdriving value OD(20,34) to obtain the target overdriving value OD(12, 34). According to the above descriptions, an operation detail of the four dots interpolation is as follows:

$$OD(10, 34) = 40 + \left\{\frac{34-30}{40-30}\right\} \times \{50-40\} = 44$$

$$OD(20, 34) = 35 + \left\{\frac{34-30}{40-30}\right\} \times \{45-35\} = 39$$

$$OD(12, 34) = 39 + \left\{\frac{20-12}{20-10}\right\} \times \{44-39\} = 43$$

Moreover, the four dots interpolation operation may also include following steps. An interpolation operation is first performed according to the previous gray value PSG(12), the first previous gray reference value (10), the second previous gray reference value (20), and the first overdriving values OD(10,30) and OD(20,30) corresponding to the first gray reference value (30) to obtain an overdriving value OD(12, 30). Moreover, an interpolation operation is performed according to the previous gray value PSG(12), the first previous gray reference value (10), the second previous gray reference value (20), and the first overdriving values OD(10, 40) and OD(20,40) corresponding to the second gray reference value (40) to obtain an overdriving value OD(12, 40). Finally, an interpolation operation is performed according to the current gray value SG(34), the first gray reference value (30), the second gray reference value (40), the overdriving values OD(12,30) and OD(12,40) to obtain the target overdriving value OD(12,34). According to the above descriptions, another operation detail of the four dots interpolation is as follows:

$$OD(12, 30) = 40 + \left\{\frac{12-10}{20-10}\right\} \times \{35-40\} = 39$$

$$OD(12, 40) = 50 + \left\{\frac{12-10}{20-10}\right\} \times \{40-50\} = 49$$

$$OD(12, 34) = 39 + \left\{\frac{34-30}{40-30}\right\} \times \{49-39\} = 43$$

Figure 4A:
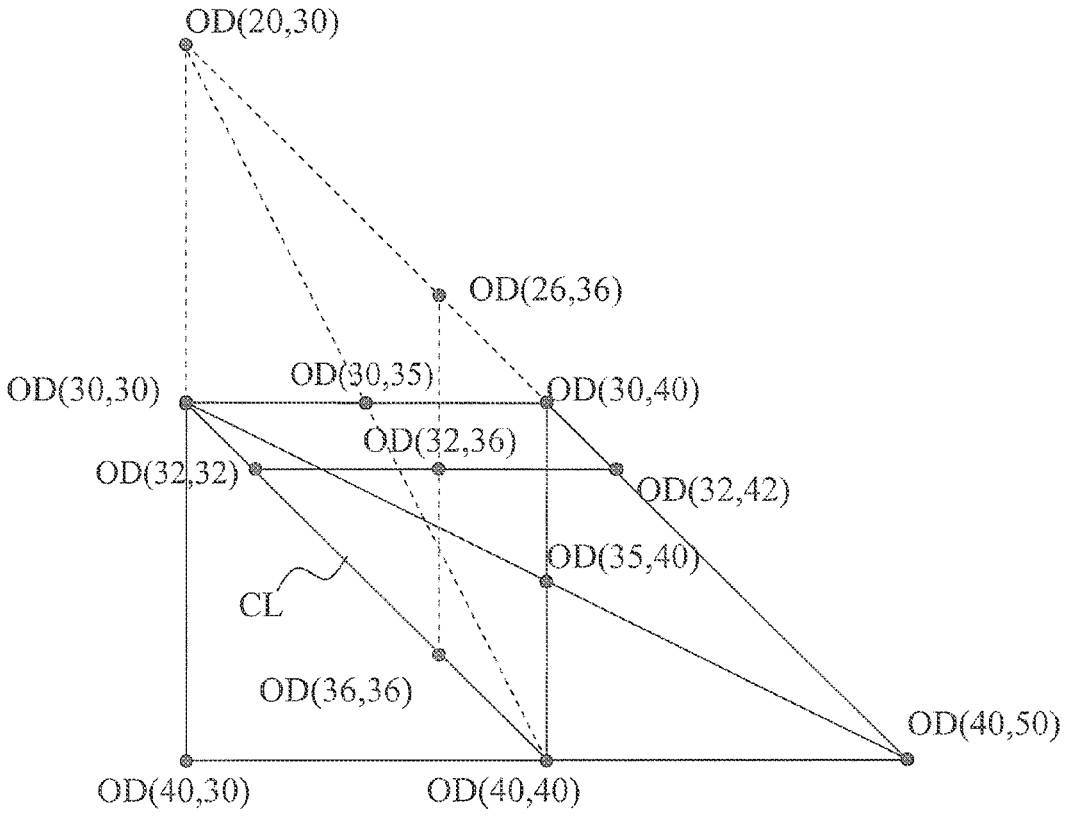
FIG. 4A is an operation schematic diagram of a parallelogram interpolation method according to an embodiment of the invention.

FIG. 4A is an operation schematic diagram of a parallelogram interpolation method according to an embodiment of the invention. Referring to FIG. 4A, generally, the parallelogram interpolation operation can be used in case that two first overdriving values are located on a diagonal of the look-up table, i.e. the first gray reference value is the same to the first previous gray reference value and the second gray reference value is the same to the second previous gray reference value. Assumed that the current gray value SG received by the overdriving calculating unit 155 is 36, the previous gray value PSG is 32, and according to the look-up table, the first gray reference value is 30, the second gray reference value is 40, the first previous gray reference value is 30, and the second previous gray reference value is 40, the first overdriving values OD(30,30), OD(30, 40), OD(40,30) and OD(40,40) are then respectively assumed to be 30, 60, 10 and 40.

As shown in FIG. 4A, the diagonal CL of the look-up table cuts a region formed by the first overdriving values OD(30, 30), OD(30,40), OD(40,30) and OD(40,40) into two triangles, where the triangle formed by the first overdriving values OD(30,30), OD(30, 40) and OD(40,40) is regarded as an upper triangle, and the triangle formed by the first overdriving values OD(30,30), OD(40,30) and OD(40,40) is regarded as a lower triangle. Since linear relationships at two sides of the diagonal CL are different, if the target overdriving value OD to be obtained is located in the upper triangle, namely, when a difference between the current gray value SG and the first gray reference value is greater than a difference between the previous gray value PSG and the first previous gray reference value, the first overdriving values OD(30,30), OD(30,40) and OD(40,40) are used in the operation. Comparatively, if the target overdriving value OD to be obtained is located in the lower triangle, namely, when the difference between the current gray value SG and the first gray reference value is smaller than the difference between the previous gray value PSG and the first previous gray reference value, the first overdriving values OD(30,30), OD(40,30) and OD(40,40) are used in the operation. In the present embodiment, it is assumed that the target overdriving value OD to be obtained is OD(32,36), namely, the target overdriving value OD is located in the upper triangle.

In the parallelogram interpolation operation, an operation is performed according to the first overdriving values OD(30, 40) and OD(40,40) corresponding to the second gray reference value (40) to obtain an average overdriving value OD(35,40), wherein the average overdriving value OD(35, 40) serves as a center point of the parallelogram, and fourth corner of the parallelogram is obtained according to the average overdriving value OD(35,40). According to a characteristic of the parallelogram, distances between the center point and the opposite sides are the same, so that an operation can be performed according to the average overdriving value OD(35,40) and the first overdriving value OD(30,30) corresponding to the first gray reference value (30) and the first previous gray reference value (30) to obtain an extending overdriving value OD(40,50), where the first overdriving values OD(30,30), OD(30,40) and OD(40,40) and the extending overdriving value OD(40,50) form a parallelogram, and an interpolation operation is performed according to the first overdriving values OD(30,30), OD(30,40) and OD(40,40) and the extending overdriving value OD(40,50) to obtain a target overdriving value OD(32,36).

According to the above descriptions, an interpolation operation is performed according to the previous gray value PSG(32), the first previous gray reference value (30), the second previous gray reference value (40), the extending overdriving value OD(40,50), and the first overdriving value OD(30,40) corresponding to the second gray reference value (40) and the first previous gray reference value (30) to obtain a second overdriving value OD(32,42). Moreover, an interpolation operation is performed according to the previous gray value PSG(32), the first previous gray reference value (30), the second previous gray reference value (40), the first overdriving value OD(30,30) corresponding to the first gray reference value (30) and the first previous gray reference value (30), and the first overdriving value OD(40,40) corresponding to the second gray reference value (40) and the second previous gray reference value (40) to obtain a third overdriving value OD(32,32). Finally, an interpolation operation is performed according to the current gray value (36), the first gray reference value (30), the second gray reference value (40), the second overdriving value OD(32,42) and the third overdriving value OD(32,32) to obtain the target overdriving value OD(32,36). According to the above descriptions, the operation detail of the parallelogram interpolation of the target overdriving value OD in the upper triangle is as follows:

$$OD(35, 40) = \frac{60+40}{2} = 50$$

$$OD(40, 50) = (50-30)\times 2 + 30 = 70$$

$$OD(32, 42) = 60 + \left\{\frac{32-30}{40-30}\right\} \times \{70-60\} = 62$$

$$OD(32, 32) = 30 + \left\{\frac{32-30}{40-30}\right\} \times \{40-30\} = 32$$

$$OD(32, 36) = 32 + \left\{\frac{36-32}{40-30}\right\} \times \{62-32\} = 44$$

The parallelogram interpolation operation of the target overdriving value OD in the upper triangle can also be as follows. An operation is first performed according to the first overdriving values OD(30,30) and OD(30,40) corresponding to the first previous gray reference value (30) to obtain an average overdriving value OD(30,35). Then, an operation is performed according to the average overdriving value OD(30,35) and the first overdriving value OD(40,40) corresponding to the second gray reference value (40) and the second previous gray reference value (40) to obtain an extending overdriving value OD(20,30), where the first over driving values OD(30,30), OD (30,40) and OD (40,40) and the overdriving value OD(20,30) form another parallelogram.

Then, an interpolation operation is performed according to the current gray value SG(36), the first gray reference value (30), the second gray reference value (40), the extending overdriving value OD(20,30), and the first overdriving value OD(30,40) corresponding to the second gray reference value (40) and the first previous gray reference value (30) to obtain a second overdriving value OD(26,36). Moreover, an interpolation operation is performed according to the current gray value SG(36), the first gray reference value (30), the second gray reference value (40), the first overdriving value OD (30,30) corresponding to the first gray reference value (30) and the first previous gray reference value (30), and the first overdriving value OD(40,40) corresponding to the second gray reference value (40) and the second previous gray reference value (40) to obtain a third overdriving value OD(36, 36).

Finally, an interpolation operation is performed according to the previous gray value PSG(32), the first previous gray reference value (30), the second previous gray reference value (40), the second overdriving value OD(26,36) and the third overdriving value OD(36,36) to obtain the target overdriving value OD(32,36). According to the above descriptions, the operation detail of the parallelogram interpolation of the target overdriving value OD in the upper triangle is as follows:

$$OD(30, 35) = \frac{30+60}{2} = 45$$

$$OD(20, 30) = (45-40)\times 2 + 40 = 50$$

$$OD(26, 36) = 50 + \left\{\frac{36-30}{40-30}\right\} \times \{60-50\} = 56$$

-continued $$OD(36, 36) = 30 + \left\{\frac{36-30}{40-30}\right\} \times \{40-30\} = 36$$

$$OD(32, 36) = 36 + \left\{\frac{36-32}{40-30}\right\} \times \{56-36\} = 44$$

Figure 4B:
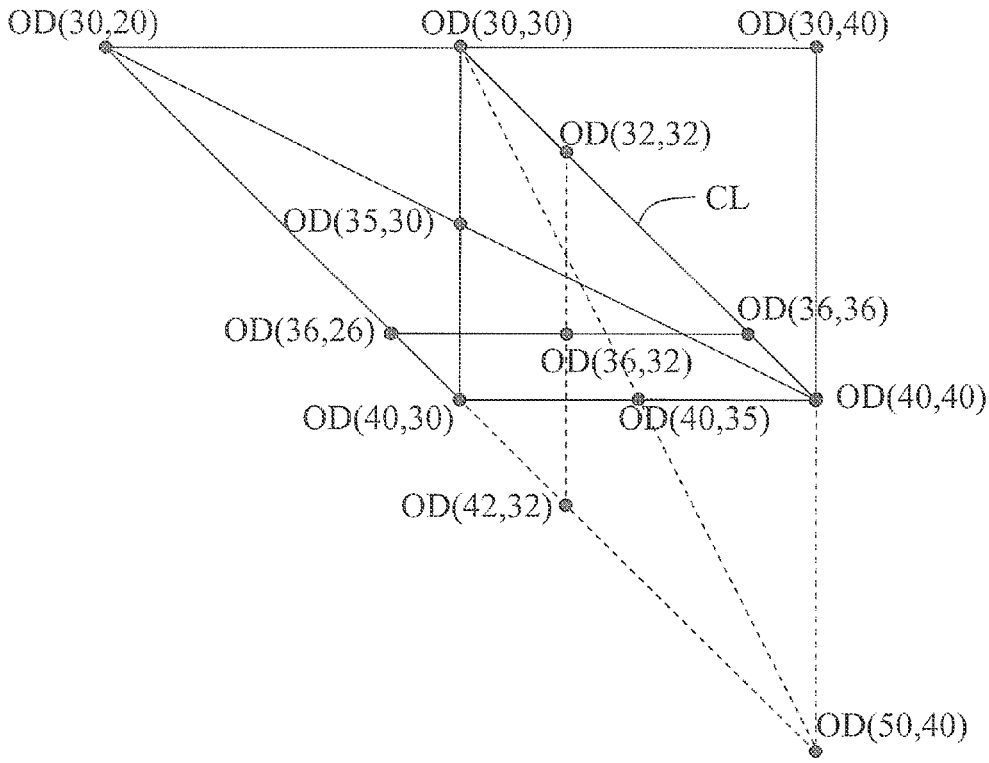
FIG. 4B is an operation schematic diagram of another parallelogram interpolation method according to an embodiment of the invention.

FIG. 4B is an operation schematic diagram of another parallelogram interpolation method according to an embodiment of the invention. Referring to FIG. 4B, in the present embodiment, it is assumed that the target overdriving value OD to be obtained is OD(36,32), i.e. the target overdriving value OD is located in the lower triangle. In the parallelogram interpolation operation, an operation is performed according to the first overdriving values OD(30,30) and OD(40,30) corresponding to the first gray reference value (30) to obtain an average overdriving value OD(35,30). Moreover, an operation is performed according to the average overdriving value OD(35,30) and the first overdriving value OD(40,40) corresponding to the second gray reference value (40) and the second previous gray reference value (40) to obtain an extending overdriving value OD(30,20).

Then, an interpolation operation is performed according to the previous gray value PSG(36), the first previous gray reference value (30), the second previous gray reference value (40), the extending overdriving value OD(30,20), and the first overdriving value OD(40,30) corresponding to the first gray reference value (30) and the second previous gray reference value (40) to obtain a second overdriving value OD(36,26). Moreover, an interpolation operation is performed according to the previous gray value PSG(36), the first previous gray reference value (30), the second previous gray reference value (40), the first overdriving value OD(30,30) corresponding to the first gray reference value (30) and the first previous gray reference value (30), and the first overdriving value OD(40,40) corresponding to the second gray reference value (40) and the second previous gray reference value (40) to obtain a third overdriving value OD(36,36).

Finally, an interpolation operation is performed according to the current gray value SG(32), the first gray reference value (30), the second gray reference value (40), the second overdriving value OD(36,32) and the third overdriving value OD(36,36) to obtain the target overdriving value OD(36,32). According to the above descriptions, the operation detail of the parallelogram interpolation of the target overdriving value OD in the lower triangle is as follows:

$$OD(35, 30) = \frac{30+10}{2} = 20$$

$$OD(30, 20) = (40-20) \times 2 - 40 = 0$$

$$OD(36, 26) = 0 + \left\{\frac{36-30}{40-30}\right\} \times \{10-0\} = 6$$

$$OD(36, 36) = 30 + \left\{\frac{36-30}{40-30}\right\} \times \{40-30\} = 36$$

$$OD(32, 36) = 6 + \left\{\frac{32-26}{40-30}\right\} \times \{36-6\} = 24$$

Moreover, the parallelogram interpolation operation of the target overdriving value OD in the lower triangle can also be as follows. An operation is performed according to the first overdriving values OD(40,30) and OD(40,40) corresponding to the second previous gray reference value (40) to obtain an average overdriving value OD(40,35). Moreover, an operation is performed according to the average overdriving value OD(40,35) and the first overdriving value OD(30,30) corresponding to the first gray reference value (30) and the first previous gray reference value (30) to obtain an extending overdriving value OD(50,40).

Then, an interpolation operation is performed according to the current gray value SG(32), the first gray reference value (30), the second gray reference value (40), the extending overdriving value OD(50,40), and the first overdriving value OD(40,30) corresponding to the first gray reference value (30) and the second previous gray reference value (40) to obtain a second overdriving value OD(42,32). Moreover, an interpolation operation is performed according to the current gray value SG(32), the first gray reference value (30), the second gray reference value (40), the first overdriving value OD(30,30) corresponding to the first gray reference value (30) and the first previous gray reference value (30), and the first overdriving value (40,40) corresponding to the second gray reference value (40) and the second previous gray reference value (40) to obtain a third overdriving value OD(32,32).

Finally, an interpolation operation is performed according to the previous gray value PSG(36), the first previous gray reference value (30), the second previous gray reference value (40), the second overdriving value OD(42,32) and the third overdriving value OD(32,32) to obtain the target overdriving value OD(36,32). According to the above descriptions, the operation detail of the parallelogram interpolation of the target overdriving value OD in the lower triangle is as follows:

$$OD(40, 35) = \frac{40+10}{2} = 25$$

$$OD(50, 40) = (25-30) \times 2 + 30 = 20$$

$$OD(42, 32) = 10 + \left\{\frac{32-30}{40-30}\right\} \times \{20-10\} = 12$$

$$OD(32, 32) = 30 + \left\{\frac{32-30}{40-30}\right\} \times \{40-30\} = 32$$

$$OD(32, 36) = 12 + \left\{\frac{42-36}{40-30}\right\} \times \{32-12\} = 24$$

It should be noticed that the aforementioned four dots interpolation operation and the parallelogram interpolation operation can be applied in case that the current gray value SG is not equal to the gray reference value and the previous gray value PSG is not equal to the previous gray reference value. In other words, when the current gray value SG is not equal to the first gray reference value and the second gray reference value, and the previous gray value PSG is not equal to the first previous gray reference value and the second previous gray reference value, the four dots interpolation operation or the parallelogram interpolation operation can be performed. When one of the conditions that the current gray value SG is equal to the gray reference value and the previous gray value PSG is equal to the previous gray reference value is satisfied, an interpolation operation can be directly used to obtain the target overdriving value OD. When the current gray value SG is equal to the gray reference value and the previous gray value PSG is equal to the previous gray reference value, the target overdriving value OD can be obtained by directly looking up the look-up table.

Figure 5:
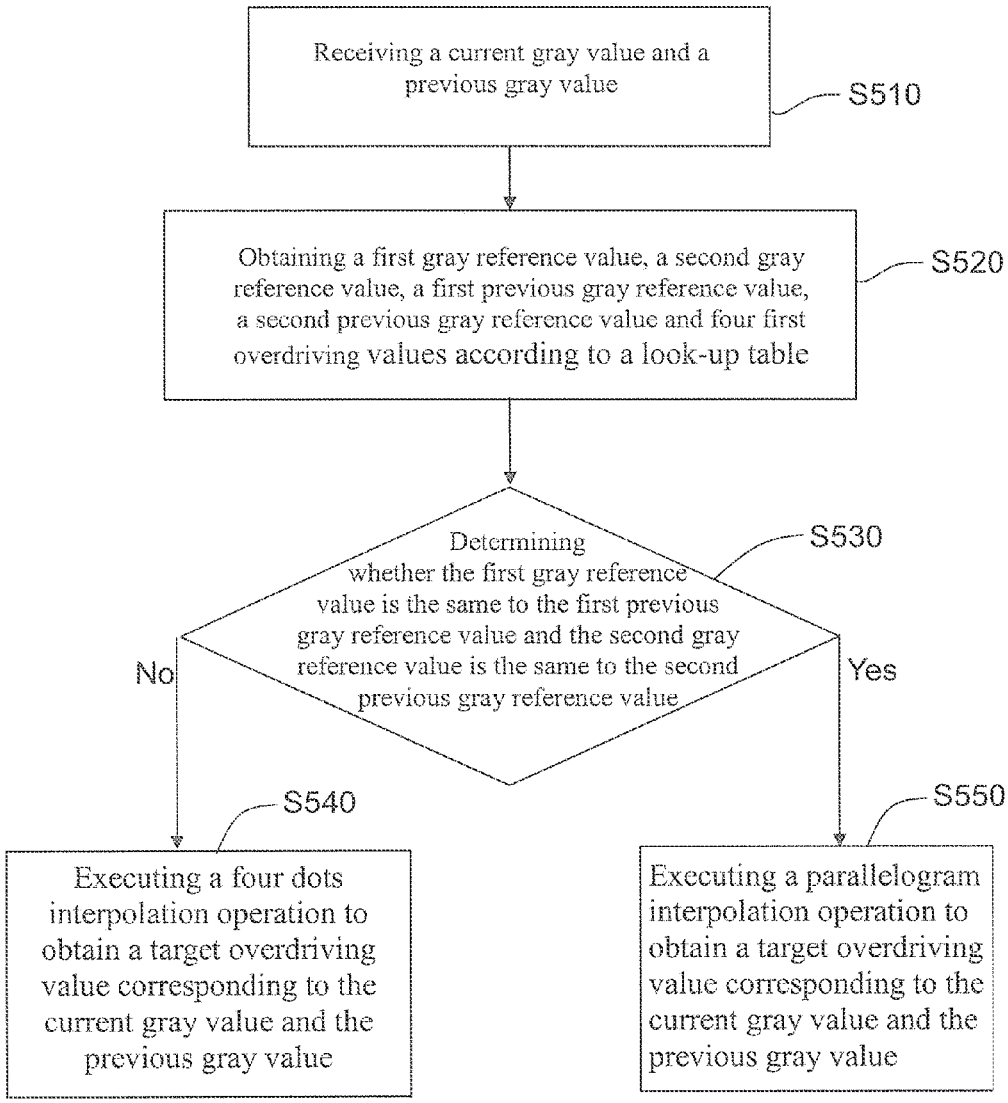
FIG. 5 is a flowchart illustrating an overdriving value generating method according to an embodiment of the invention.

According to the above descriptions, an overdriving value generating method can be deduced for the overdriving calculating unit 155. FIG. 5 is a flowchart illustrating an overdriving value generating method according to an embodiment of the invention. Referring to FIG. 5, the current gray value SG and the previous gray value PSG are first received (step S510), where the current gray value SG and the previous gray value PSG commonly correspond to a pixel of the LCD panel 110. Then, in step S520, a first gray reference value and a second gray reference value closed to the current gray value SG, and a first previous gray reference value and a second previous gray reference value closed to the previous gray value PSG are obtained according to a look-up table. Moreover, four first overdriving values are obtained according the first gray reference value, the second gray reference value, the first previous gray reference value and the second previous gray reference value.

Then, it is determined whether the first gray reference value is the same to the first previous gray reference value and the second gray reference value is the same to the second previous gray reference value (step S530). When the first gray reference value is different to the first previous gray reference value and the second gray reference value is different to the second previous gray reference value, the target overdriving value OD corresponding to the current gray value SG and the previous gray value PSG is obtained through the four dots interpolation operation according to the current gray value SG, the previous gray value PSG, the first gray reference value, the second gray reference value, the first previous gray reference value, the second previous gray reference value and the first overdriving values (Step S540). Where, the four dots interpolation operation is as that described above, which is not repeated herein.

When the first gray reference value is the same to the first previous gray reference value, and the second gray reference value is the same to the second previous gray reference value, the target overdriving value OD corresponding to the current gray value SG and the previous gray value PSG is obtained through the parallelogram interpolation operation according to the current gray value SG, the previous gray value PSG, the first gray reference value, the second gray reference value, the first previous gray reference value, the second previous gray reference value and the first overdriving values (step S550). Where, the parallelogram interpolation operation is as that described above, which is not repeated herein.

In summary, in the overdriving value generating method, the first gray reference value, the second gray reference value, the first previous gray reference value, the second previous gray reference value and the four first overdriving values are obtained according to the current gray value and the previous gray value. Moreover, it is determined to perform the four dots interpolation operation or the parallelogram interpolation operation to obtain the target overdriving value corresponding to the current gray value and the previous gray value according to whether the first gray reference value is equal to the first previous gray reference value and whether the second gray reference value is equal to the second previous gray reference value. In this way, accuracy of the overdriving value is improved while the size of the look-up table is reduced. Moreover, in case of the same size of the look-up table, the accuracy of the output overdriving value is improved. In addition, under a premise of maintaining the accuracy, the size of the look-up table can be reduced, so that a memory capacity can be reduced to reduce the hardware cost.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An overdriving value generating method, adapted to a liquid crystal display (LCD), and the overdriving value generating method comprising:

receiving a current gray value and a previous gray value, wherein the current gray value and the previous gray value correspond to a pixel of the LCD;

obtaining a first gray reference value and a second gray reference value closed to the current gray value, and a first previous gray reference value and a second previous gray reference value closed to the previous gray value according to a look-up table, and obtaining four first overdriving values according the first gray reference value, the second gray reference value, the first previous gray reference value and the second previous gray reference value, wherein the first gray reference value is the same to the first previous gray reference value, and the second gray reference value is the same to the second previous gray reference value; and obtaining a target overdriving value corresponding to the current gray value and the previous gray value through a parallelogram interpolation operation according to the current gray value, the previous gray value, the first gray reference value, the second gray reference value, the first previous gray reference value, the second previous gray reference value and the first overdriving values, wherein the parallelogram interpolation operation calculates an extending overdriving value according to three of the first overdriving values closed to the target overdriving value, and then performs an interpolation operation according to the three first overdriving values closed to the target overdriving value and the extending overdriving value to obtain the overdriving value, and the extending overdriving value is in outside of an area formed by the three first overdriving values closed to the target overdriving value.

2. The overdriving value generating method as claimed in claim 1, wherein when a difference between the current gray value and the first gray reference value is greater than a difference between the previous gray value and the first previous gray reference value, the parallelogram interpolation operation comprises:

performing an operation according to two first overdriving values corresponding to the second gray reference value to obtain an average overdriving value;

performing an operation according to the average overdriving value and the first overdriving value corresponding to the first gray reference value and the first previous gray reference value to obtain the extending overdriving value, wherein the extending overdriving value is twice of the average overdriving value minus the first overdriving value corresponding to the first gray reference value and the first previous gray reference value;

performing an interpolation operation according to the previous gray value, the first previous gray reference value, the second previous gray reference value, the extending overdriving value, and the first overdriving value corresponding to the second gray reference value and the first previous gray reference value to obtain a second overdriving value;

performing an interpolation operation according to the previous gray value, the first previous gray reference value, the second previous gray reference value, the first overdriving value corresponding to the first gray reference value and the first previous gray reference value, and the first overdriving value corresponding to the second gray reference value and the second previous gray reference value to obtain a third overdriving value; and performing an interpolation operation according to the current gray value, the first gray reference value, the second gray reference value, the second overdriving value and the third overdriving value to obtain the target overdriving value.

3. The overdriving value generating method as claimed in claim 1, wherein when a difference between the current gray value and the first gray reference value is greater than a difference between the previous gray value and the first previous gray reference value, the parallelogram interpolation operation comprises:

performing an operation according to two first overdriving values corresponding to the first previous gray reference value to obtain an average overdriving value;

performing an operation according to the average overdriving value and the first overdriving value corresponding to the second gray reference value and the second previous gray reference value to obtain the extending overdriving value, wherein the extending overdriving value is twice of the average overdriving value minus the first overdriving value corresponding to the second gray reference value and the second previous gray reference value;

performing an interpolation operation according to the current gray value, the first gray reference value, the second gray reference value, the extending overdriving value, and the first overdriving value corresponding to the second gray reference value and the first previous gray reference value to obtain a second overdriving value;

performing an interpolation operation according to the current gray value, the first gray reference value, the second gray reference value, the first overdriving value corresponding to the first gray reference value and the first previous gray reference value, and the first overdriving value corresponding to the second gray reference value and the second previous gray reference value to obtain a third overdriving value; and performing an interpolation operation according to the previous gray value, the first previous gray reference value, the second previous gray reference value, the second overdriving value and the third overdriving value to obtain the target overdriving value.

4. The overdriving value generating method as claimed in claim 1, wherein when a difference between the current gray value and the first gray reference value is smaller than a difference between the previous gray value and the first previous gray reference value, the parallelogram interpolation operation comprises:

performing an operation according to two first overdriving values corresponding to the first gray reference value to obtain an average overdriving value;

performing an operation according to the average overdriving value and the first overdriving value corresponding to the second gray reference value and the second previous gray reference value to obtain the extending overdriving value, wherein the extending overdriving value is twice of the average overdriving value minus the first overdriving value corresponding to the second gray reference value and the second previous gray reference value;

performing an interpolation operation according to the previous gray value, the first previous gray reference value, the second previous gray reference value, the extending overdriving value, and the first overdriving value corresponding to the first gray reference value and the second previous gray reference value to obtain a second overdriving value;

performing an interpolation operation according to the previous gray value, the first previous gray reference value, the second previous gray reference value, the first overdriving value corresponding to the first gray reference value and the first previous gray reference value, and the first overdriving value corresponding to the second gray reference value and the second previous gray reference value to obtain a third overdriving value; and performing an interpolation operation according to the current gray value, the first gray reference value, the second gray reference value, the second overdriving value and the third overdriving value to obtain the target overdriving value.

5. The overdriving value generating method as claimed in claim 1, wherein the current gray value is not equal to the first gray reference value and the second gray reference value.

6. The overdriving value generating method as claimed in claim 1, wherein the previous gray value is not equal to the first previous gray reference value and the second previous gray reference value.

7. An overdriving value generating method, adapted to a liquid crystal display (LCD), and the overdriving value generating method comprising:

receiving a current gray value and a previous gray value, wherein the current gray value and the previous gray value correspond to a pixel of the LCD;

obtaining a first gray reference value and a second gray reference value closed to the current gray value, and a first previous gray reference value and a second previous gray reference value closed to the previous gray value according to a look-up table, and obtaining four first overdriving values according the first gray reference value, the second gray reference value, the first previous gray reference value and the second previous gray reference value, wherein the first gray reference value is the same to the first previous gray reference value, and the second gray reference value is the same to the second previous gray reference value; and obtaining a target overdriving value corresponding to the current gray value and the previous gray value through a parallelogram interpolation operation according to the current gray value, the previous gray value, the first gray reference value, the second gray reference value, the first previous gray reference value, the second previous gray reference value and the first overdriving values, wherein when a difference between the current gray value and the first gray reference value is smaller than a difference between the previous gray value and the first previous gray reference value, the parallelogram interpolation operation comprises:

performing an operation according to two first overdriving values corresponding to the second previous gray reference value to obtain an average overdriving value;

performing an operation according to the average overdriving value and the first overdriving value corresponding to the first gray reference value and the first previous gray reference value to obtain an extending overdriving value, wherein the extending overdriving value is twice of the average overdriving value minus the first overdriving value corresponding to the first gray reference value and the first previous gray reference value;

performing an interpolation operation according to the current gray value, the first gray reference value, the second gray reference value, the extending overdriving value, and the first overdriving value corresponding to the first gray reference value and the second previous gray reference value to obtain a second overdriving value;

performing an interpolation operation according to the current gray value, the first gray reference value, the second gray reference value, the first overdriving value corresponding to the first gray reference value and the first previous gray reference value, and the first overdriving value corresponding to the second gray reference value and the second previous gray reference value to obtain a third overdriving value; and performing an interpolation operation according to the previous gray value, the first previous gray reference value, the second previous gray reference value, the second overdriving value and the third overdriving value to obtain the target overdriving value.

8. An overdriving value generating method, adapted to a liquid crystal display (LCD), and the overdriving value generating method comprising:

receiving a current gray value and a previous gray value, wherein the current gray value and the previous gray value correspond to a pixel of the LCD;

obtaining a first gray reference value and a second gray reference value closed to the current gray value, and a first previous gray reference value and a second previous gray reference value closed to the previous gray value are obtained according to a look-up table, and obtaining four first overdriving values according the first gray reference value, the second gray reference value, the first previous gray reference value and the second previous gray reference value;

when the first gray reference value is different to the first previous gray reference value or the second gray reference value is different to the second previous gray reference value, obtaining a target overdriving value corresponding to the current gray value and the previous gray value through a four dots interpolation operation according to the current gray value, the previous gray value, the first gray reference value, the second gray reference value, the first previous gray reference value, the second previous gray reference value and the first overdriving values; and when the first gray reference value is the same to the first previous gray reference value and the second gray reference value is the same to the second previous gray reference value, obtaining the target overdriving value through a parallelogram interpolation operation according to the current gray value, the previous gray value, the first gray reference value, the second gray reference value, the first previous gray reference value, the second previous gray reference value and the first overdriving values, wherein the parallelogram interpolation operation calculates an extending overdriving value according to three of the first overdriving values closed to the target overdriving value, and then performs an interpolation operation according to the three first overdriving values closed to the target overdriving value and the extending overdriving value to obtain the overdriving value, and the extending overdriving value is in outside of an area formed by the three first overdriving values closed to the target overdriving value.

9. The overdriving value generating method as claimed in claim 8, wherein the four dots interpolation operation comprises:

performing an interpolation operation according to the current gray value, the first gray reference value, the second gray reference value, and two first overdriving values corresponding to the first previous gray reference value to obtain a second overdriving value;

performing an interpolation operation according to the current gray value, the first gray reference value, the second gray reference value, and two first overdriving values corresponding to the second previous gray reference value to obtain a third overdriving value; and performing an interpolation operation according to the previous gray value, the first previous gray reference value, the second previous gray reference value, the second overdriving value and the third overdriving value to obtain the target overdriving value.

10. The overdriving value generating method as claimed in claim 8, wherein the four dots interpolation operation comprises:

performing an interpolation operation according to the previous gray value, the first previous gray reference value, the second previous gray reference value, and two first overdriving values corresponding to the first gray reference value to obtain a second overdriving value;

performing an interpolation operation according to the previous gray value, the first previous gray reference value, the second previous gray reference value, and two first overdriving values corresponding to the second gray reference value to obtain a third overdriving value; and performing an interpolation operation according to the current gray value, the first gray reference value, the second gray reference value, the second overdriving value and the third overdriving value to obtain the target overdriving value.

11. The overdriving value generating method as claimed in claim 8, wherein when a difference between the current gray value and the first gray reference value is greater than a difference between the previous gray value and the first previous gray reference value, the parallelogram interpolation operation comprises:

performing an operation according to two first overdriving values corresponding to the second gray reference value to obtain an average overdriving value;

performing an operation according to the average overdriving value and the first overdriving value corresponding to the first gray reference value and the first previous gray reference value to obtain the extending overdriving value, wherein the extending overdriving value is twice of the average overdriving value minus the first overdriving value corresponding to the first gray reference value and the first previous gray reference value;

performing an interpolation operation according to the previous gray value, the first previous gray reference value, the second previous gray reference value, the extending overdriving value, and the first overdriving value corresponding to the second gray reference value and the first previous gray reference value to obtain a second overdriving value;

performing an interpolation operation according to the previous gray value, the first previous gray reference value, the second previous gray reference value, the first overdriving value corresponding to the first gray reference value and the first previous gray reference value, and the first overdriving value corresponding to the second gray reference value and the second previous gray reference value to obtain a third overdriving value; and performing an interpolation operation according to the current gray value, the first gray reference value, the second gray reference value, the second overdriving value and the third overdriving value to obtain the target overdriving value.

12. The overdriving value generating method as claimed in claim 8, wherein when a difference between the current gray value and the first gray reference value is greater than a difference between the previous gray value and the first previous gray reference value, the parallelogram interpolation operation comprises:

performing an operation according to two first overdriving values corresponding to the first previous gray reference value to obtain an average overdriving value;

performing an operation according to the average overdriving value and the first overdriving value corresponding to the second gray reference value and the second previous gray reference value to obtain the extending overdriving value, wherein the extending overdriving value is twice of the average overdriving value minus the first overdriving value corresponding to the second gray reference value and the second previous gray reference value;

performing an interpolation operation according to the current gray value, the first gray reference value, the second gray reference value, the extending overdriving value, and the first overdriving value corresponding to the second gray reference value and the first previous gray reference value to obtain a second overdriving value;

performing an interpolation operation according to the current gray value, the first gray reference value, the second gray reference value, the first overdriving value corresponding to the first gray reference value and the first previous gray reference value, and the first overdriving value corresponding to the second gray reference value and the second previous gray reference value to obtain a third overdriving value; and performing an interpolation operation according to the previous gray value, the first previous gray reference value, the second previous gray reference value, the second overdriving value and the third overdriving value to obtain the target overdriving value.

13. The overdriving value generating method as claimed in claim 8, wherein when a difference between the current gray value and the first gray reference value is smaller than a difference between the previous gray value and the first previous gray reference value, the parallelogram interpolation operation comprises:

performing an operation according to two first overdriving values corresponding to the first gray reference value to obtain an average overdriving value;

performing an operation according to the average overdriving value and the first overdriving value corresponding to the second gray reference value and the second previous gray reference value to obtain the extending overdriving value, wherein the extending overdriving value is twice of the average overdriving value minus the first overdriving value corresponding to the second gray reference value and the second previous gray reference value;

performing an interpolation operation according to the previous gray value, the first previous gray reference value, the second previous gray reference value, the extending overdriving value, and the first overdriving value corresponding to the first gray reference value and the second previous gray reference value to obtain a second overdriving value;

performing an interpolation operation according to the previous gray value, the first previous gray reference value, the second previous gray reference value, the first overdriving value corresponding to the first gray reference value and the first previous gray reference value, and the first overdriving value corresponding to the second gray reference value and the second previous gray reference value to obtain a third overdriving value; and performing an interpolation operation according to the current gray value, the first gray reference value, the second gray reference value, the second overdriving value and the third overdriving value to obtain the target overdriving value.

14. The overdriving value generating method as claimed in claim 8, wherein when a difference between the current gray value and the first gray reference value is smaller than a difference between the previous gray value and the first previous gray reference value, the parallelogram interpolation operation comprises:

performing an operation according to two first overdriving values corresponding to the second previous gray reference value to obtain an average overdriving value;

performing an operation according to the average overdriving value and the first overdriving value corresponding to the first gray reference value and the first previous gray reference value to obtain the extending overdriving value, wherein the extending overdriving value is twice of the average overdriving value minus the first overdriving value corresponding to the first gray reference value and the first previous gray reference value;

performing an interpolation operation according to the current gray value, the first gray reference value, the second gray reference value, the extending overdriving value, and the first overdriving value corresponding to the first gray reference value and the second previous gray reference value to obtain a second overdriving value;

performing an interpolation operation according to the current gray value, the first gray reference value, the second gray reference value, the first overdriving value corresponding to the first gray reference value and the first previous gray reference value, and the first overdriving value corresponding to the second gray reference value and the second previous gray reference value to obtain a third overdriving value; and performing an interpolation operation according to the previous gray value, the first previous gray reference value, the second previous gray reference value, the second overdriving value and the third overdriving value to obtain the target overdriving value.

15. The overdriving value generating method as claimed in claim 8, wherein the current gray value is not equal to the first gray reference value and the second gray reference value.

16. The overdriving value generating method as claimed in claim 8, wherein the previous gray value is not equal to the first previous gray reference value and the second previous gray reference value.

* * * * *